US008931565B2

(12) United States Patent
Desranleau et al.

(10) Patent No.: US 8,931,565 B2
(45) Date of Patent: Jan. 13, 2015

(54) DELAYED OPENING WELLBORE TUBULAR PORT CLOSURE

(75) Inventors: Christopher Denis Desranleau, Sherwood Park (CA); Daniel Jon Themig, Calgary (CA); Cameron Radtke, Mahooz (BH); Ryan Fredrick Addy, Leduc (CA)

(73) Assignee: Packers Plus Energy Services Inc., Calgary (CA)

( * ) Notice: Subject to any disclaimer, the term of this patent is extended or adjusted under 35 U.S.C. 154(b) by 334 days.

(21) Appl. No.: 13/230,620

(22) Filed: Sep. 12, 2011

(65) Prior Publication Data

US 2012/0111574 A1 May 10, 2012

Related U.S. Application Data

(60) Provisional application No. 61/385,480, filed on Sep. 22, 2010.

(51) Int. Cl.

| | |
|---|---|
| ***E21B 34/06*** | (2006.01) |
| ***E21B 34/14*** | (2006.01) |
| *E21B 34/00* | (2006.01) |

(52) U.S. Cl.

CPC ..... *E21B 34/14* (2013.01); *E21B 2034/007* (2013.01)

USPC ..... 166/373; 166/321; 166/320

(58) Field of Classification Search

CPC ..... E21B 34/14; E21B 2034/007

USPC ..... 166/374, 383, 386, 66.7, 169, 194, 321, 166/332.4, 318, 373, 370; 251/54

See application file for complete search history.

(56) References Cited

U.S. PATENT DOCUMENTS

| | | | |
|---|---|---|---|
| 5,123,493 | A | 6/1992 | Wenzel |
| 5,687,791 | A | 11/1997 | Beck et al. |
| 5,687,795 | A | 11/1997 | Patel et al. |
| 6,907,936 | B2 | 6/2005 | Fehr et al. |
| 7,021,384 | B2 | 4/2006 | Themig |
| 7,108,067 | B2 | 9/2006 | Themig et al. |
| 7,134,505 | B2 | 11/2006 | Fehr et al. |
| 7,353,878 | B2 | 4/2008 | Themig |
| 7,389,821 | B2 | 6/2008 | Xu |
| 7,431,091 | B2 | 10/2008 | Themig et al. |
| 7,478,678 | B2 | 1/2009 | Farrar et al. |
| 7,543,634 | B2 | 6/2009 | Fehr et al. |
| 7,748,460 | B2 | 7/2010 | Themig et al. |
| 7,762,333 | B2 | 7/2010 | Themig et al. |
| 7,779,911 | B2 | 8/2010 | Akselberg |
| 7,798,226 | B2 | 9/2010 | Themig |
| 7,861,774 | B2 | 1/2011 | Fehr et al. |
| 7,992,645 | B2 | 8/2011 | Themig |
| 8,033,331 | B2 | 10/2011 | Themig |

(Continued)

FOREIGN PATENT DOCUMENTS

| | | | |
|---|---|---|---|
| GB | 2289488 | A | 11/1995 |
| WO | 2004/088091 | A1 | 10/2004 |
| WO | 2009/132462 | A1 | 11/2009 |

*Primary Examiner* — Shane Bomar
*Assistant Examiner* — George Gray
(74) *Attorney, Agent, or Firm* — Bennett Jones LLP

(57) ABSTRACT

A wellbore tubular port closure system includes a mechanism to delay the opening of the port the port closure has been actuated to open. A port opening delay mechanism configured to act after actuation of the pressure responsive mechanism to delay full movement of the port-closure to the port-open position until after a selected time has lapsed.

25 Claims, 6 Drawing Sheets

(56) References Cited

U.S. PATENT DOCUMENTS

| | | | | |
|---|---|---|---|---|
| 8,276,675 | B2 * | 10/2012 | Williamson et al. | 166/383 |
| 2003/0127227 | A1 | 7/2003 | Fehr et al. | |
| 2007/0272411 | A1 | 11/2007 | Lopez de Cardenas et al. | |
| 2008/0314596 | A1 | 12/2008 | Themig | |
| 2009/0044944 | A1 | 2/2009 | Murray et al. | |
| 2009/0071644 | A1 | 3/2009 | Themig | |
| 2009/0084533 | A1 | 4/2009 | Rytlewski et al. | |
| 2010/0051284 | A1 | 3/2010 | Stewart | |
| 2010/0263873 | A1 | 10/2010 | Turner et al. | |
| 2011/0036590 | A1 | 2/2011 | Williamson et al. | |
| 2011/0067890 | A1 | 3/2011 | Themig | |
| 2011/0079390 | A1 | 4/2011 | Themig | |
| 2011/0100643 | A1 | 5/2011 | Themig et al. | |
| 2011/0127044 | A1 * | 6/2011 | Radford et al. | 166/373 |
| 2011/0127047 | A1 | 6/2011 | Themig et al. | |
| 2011/0192607 | A1 * | 8/2011 | Hofman et al. | 166/317 |
| 2011/0253383 | A1 | 10/2011 | Porter et al. | |

* cited by examiner

DELAYED OPENING WELLBORE TUBULAR PORT CLOSURE

FIELD

The invention relates to downhole tools and, in particular, a ported sub for a tubing string.

BACKGROUND

Port closures, such as a sliding sleeve, a gate, a mandrel, a valve, a detachable cover, a retainer holding the detachable cover in place, etc., are used in wellbore tubular strings and tools to permit selective opening of ports. The ports may provide fluid access between the annulus and the inner diameter of the tubing string or may provide fluid communication to and from a tool on the string, such as a packer.

Sometimes, although a port closure is actuated to open, it is desirable that the actual opening of the port to fluid flow be somewhat delayed.

SUMMARY

A wellbore tubular port closure system, which in one embodiment is a sleeve valve, has been invented that includes a mechanism to delay the opening of the port after the port closure has been actuated to open.

According to one aspect, a wellbore tubular port closure assembly comprises: a tubular housing including a wall defining an inner bore; a port through the wall of the tubular housing; a closure for the port, the closure having a port-closed position wherein the port is closed to fluid flow therethrough and the closure being actuable to move to a port-open position, wherein the port is exposed for fluid flow therethrough; a pressure driven mechanism for actuating the closure to an active position where the closure can move from the port-closed position to the port-open position; and a port opening delay mechanism configured to act after actuation of the pressure responsive mechanism to resist movement of the closure to the port-open position, such that arrival at the port-open position is delayed until after a selected time has lapsed.

According to another aspect, a sleeve valve assembly comprises: a tubular housing; a port through the wall of the tubular housing, a sleeve valve installed in the tubular housing and being moveable within the tubular housing from a port-closed position covering the port to a port-open position exposing the port to fluid flow therethrough; a releasable lock holding the sleeve valve in the port-closed position and actuable to release the sleeve valve for movement; a driver for applying a force to the sleeve valve to drive the sleeve valve from the port-closed position to the port-open position; and a sleeve valve movement delay mechanism configured after actuation of the releasable lock to delay movement of the sleeve valve into the port-open position until after a selected time has lapsed.

According to another aspect, there is provided a wellbore tubing string apparatus comprising: a tubing string having a wall and defining a long axis and an inner bore; a first port extending through the wall of the tubing string; a first closure for the first port, the first closure maintaining the first port in a port-closed condition sealing against fluid flow through the first port and being actuable to an opened condition exposing the first port to fluid flow from the inner bore; a second port extending through the wall of the tubing string, the second port offset from the first port along the long axis of the tubing string; a second closure for the second port, the second closure maintaining the second port in a port-closed condition sealing against fluid flow through the second port and being actuable to an opened condition exposing the second port to fluid flow from the inner bore; a pressure driven tool moveable through the tubing string inner bore to actuate the first closure and the second closure to assume active positions where the first closure and the second closure can move from their port-closed positions to their port-open positions; and a port opening delay mechanism configured to act after actuation by the pressure driven tool to resist movement of the first closure such that opening of the first port to fluid flow therethrough is delayed until after a selected time has lapsed.

According to another aspect there is provided a wellbore tubing string apparatus comprising: a tubing string having a wall and defining a long axis and an inner bore; a first port extending through the wall of the tubing string; a first sleeve valve mounted over the first port in a port-closed position, the first sleeve valve being moveable relative to the first port between the port-closed position and a port-open position permitting fluid flow through the first port from the tubing string inner bore; a second port extending through the wall of the tubing string, the second port offset from the first port along the long axis of the tubing string; a second sleeve valve mounted over the second port in a port-closed position, the second sleeve valve being moveable relative to the second port between the port-closed position and a port-open position permitting fluid flow through the second port from the tubing string inner bore; a releasable lock holding the first sleeve valve in the port-closed position and actuable to release the first sleeve valve for movement; a driver for applying a force to the first sleeve valve to drive the first sleeve valve from the port-closed position to the port-open position; and a sleeve valve movement delay mechanism configured after actuation of the releasable lock to slow movement of the first sleeve valve into the port-open position until after a selected time has lapsed.

According to another aspect of the present invention, there is provided a method for opening fluid flow ports in a tubing string, a tubing string having a wall and defining a long axis and an inner bore; a first port extending through the wall of the tubing string; a first sleeve valve mounted over the first port in a port-closed position, the first sleeve valve being moveable relative to the first port between the port-closed position and a port-open position permitting fluid flow through the first port from the tubing string inner bore; a second port extending through the wall of the tubing string, the second port offset from the first port along the long axis of the tubing string; a second sleeve valve mounted over the second port in a port-closed position, the second sleeve valve being moveable relative to the second port between the port-closed position and a port-open position permitting fluid flow through the second port from the tubing string inner bore, the method comprising: introducing a tool to the tubing string and forcing the tool through the tubing string and past the first sleeve valve and the second sleeve valve using fluid pressure, the tool actuating the first sleeve valve and the second sleeve valve to be released for movement from their port-closed positions to their port-open positions; and selecting the rate of movement of the first sleeve valve such that the first sleeve valve fails to reach the port-open position until after the tool passes the second sleeve valve.

According to another aspect of the present invention, there is provided a method for opening fluid flow ports in a tubing string, a tubing string having a wall and defining a long axis and an inner bore; a first port extending through the wall of the tubing string; a first sleeve valve mounted over the first port in a port-closed position, the first sleeve valve being moveable relative to the first port between the port-closed position and a port-open position permitting fluid flow through the first port from the tubing string inner bore; a second port extending through the wall of the tubing string, the second port offset from the first port along the long axis of the tubing string; a second sleeve valve mounted over the second port in a port-closed position, the second sleeve valve being moveable relative to the second port between the port-closed position and a port-open position permitting fluid flow through the second port from the tubing string inner bore, the method comprising: actuating the first sleeve valve and the second sleeve valve to be released for movement from their port-closed positions to their port-open positions; and applying a resisting force to the first sleeve valve such that the first sleeve valve moves at a slower rate toward the port-closed position than if the resisting force was not applied.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1A:
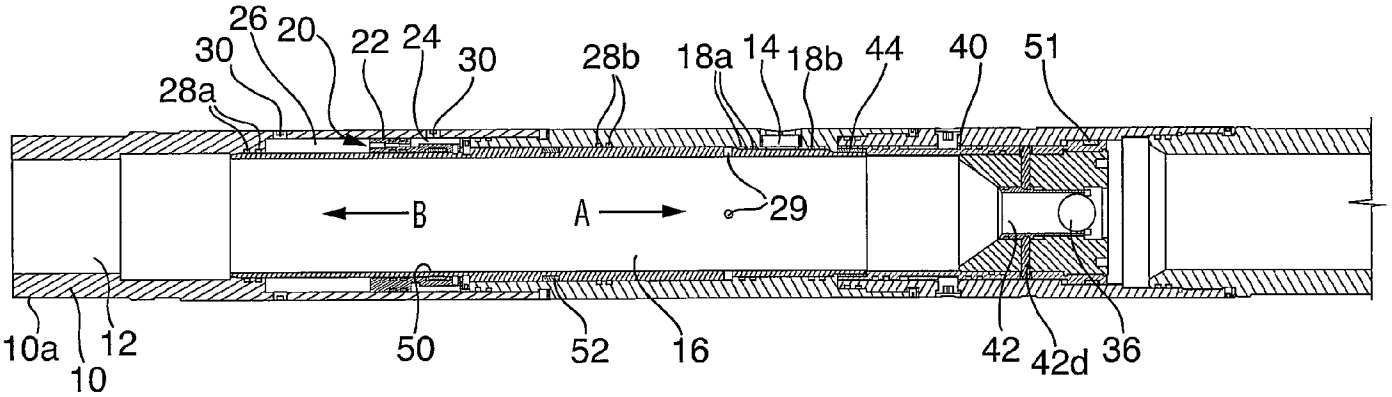
FIGS. 1A, 1B and 1C are a series of sectional views along one embodiment of a wellbore tubular port closure assembly in the form of a sleeve valve.
Figure 1B:
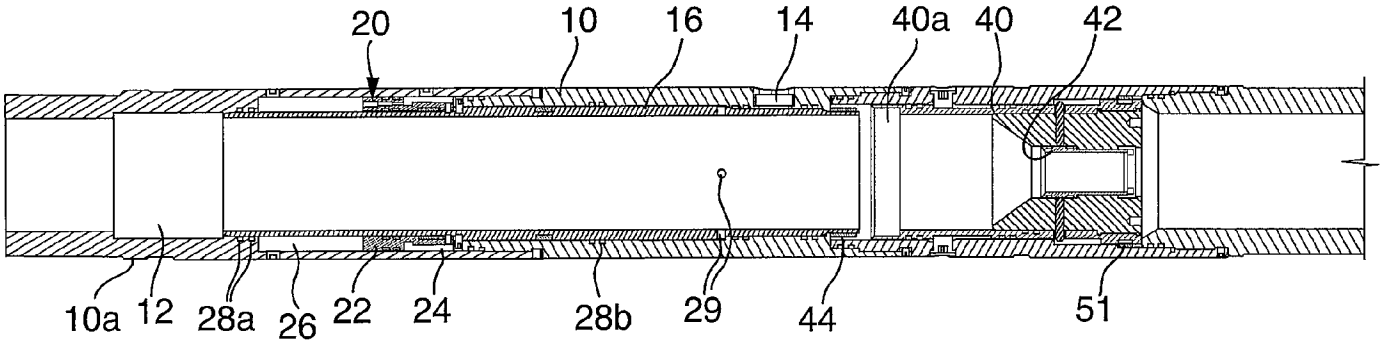

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

As noted above, a port in a wellbore tubular may sometimes be closed by a port closure so that the port can be selectively opened when it is appropriate to do so. Port closures may take various forms and be actuated in various ways.

Sometimes, depending on the process by which a port closure is actuated to open its associated port, the actuation to allow opening of the port closure occurs before the port is actually most desirably opened. As such, it is sometimes desirable that the port opening be somewhat delayed after the actual actuation of the port closure to begin moving toward the open position.

For example, sometimes it is useful that a tubing string hold pressure long enough to ensure that all pressure driven operations are completed before a valve opens. The port may be actuated to open in response to a pressured up condition, but if it opened at that time, the pressure condition in the tubing string would be disadvantageously lost. Such systems are disclosed, for example, in International application WO 2009/132462, published on Nov. 5, 2009, for the present assignee.

In some other instances, a plurality of valves are provided that are each actuable to open one or more ports. Sometimes, where it is desired to open a number of valves in one operation, a pressure driven tool is driven through the string that acts on each of the plurality of valves in turn to open the ports regulated thereby. Such systems are disclosed, for example, in U.S. Pat. No. 7,108,067, issued Sep. 19, 2006 to the present assignee. However, since the valves each open in turn as they are actuated, the pump pressures required to keep the pressure driven tool moving along the string are significant. In particular, each time a valve is actuated to open its port, an amount of fluid can escape through that port. Each port opening dissipates the pressure of the driving fluid in the string, which is intended to act on the pressure driven tool. For example, while a pressure driven tool may be effectively moved through a string by 5 or 10 bbl/min, 40 bbl/min is actually required, because fluid pressure loss occurs after each port is opened. Limited entry systems may be employed, therefore, to restrict the amount of fluid that can flow through each opened port. It is difficult to use such pressure driven tools to open a plurality of sleeve valves, if limited entry system are not also used, and even if the ports are equipped with limited entry inserts, the pump pressure may still be compromised after a number of the ports are opened.

The port closure when in a port-closed position maintains its port in a closed condition, generally sealing against fluid flow through the port. The closure is actuable to assume a port-open condition exposing the port and permitting fluid flow therethrough. The closure may take various forms. For example, in one embodiment, the closure may include a moveable structure such as a sleeve, a gate, a mandrel, a valve, a detachable cover and a retainer holding the detachable cover in place, etc.

A common port closure is a sliding sleeve that acts in a tubular to slide axially between the port-closed and the port-open positions. One embodiment, of a wellbore tubular port closure system in the form of a sliding sleeve valve is shown in FIG. 1.

Figure 1C:
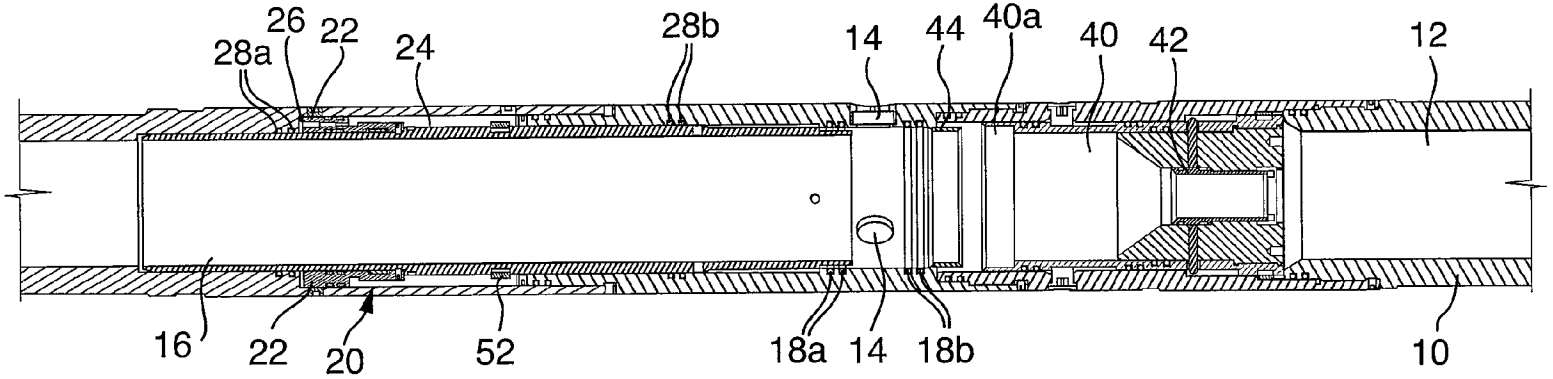

The system includes a tubular housing 10 defining an inner bore 12 and an outer surface 10*a*, a port 14 (two ports can be seen, but other numbers are possible) through the wall of the tubular housing and a closure for the port. In this embodiment the closure is a sliding sleeve 16. The sliding sleeve has a port-closed position (FIG. 1A), wherein the sliding sleeve maintains port 14 in a closed condition by overlying the port. Seals 18*a*, 18*b*, such as o-rings in glands, act between sleeve 16 and the tubular housing in the port-closed position to generally prevent leakage of fluid through the port from inner diameter 12 to outer surface 10*a*. Sleeve 16 is actuable and, thereafter, capable of moving to a port-open position (FIG. 1C). In the port-open position, the port is open to fluid flow therethrough. In FIG. 1C, for example, sleeve 16 is withdrawn from over port 14, but it will be appreciated that as soon as the sleeve is removed from its overlapping position over the seal 18*b*, the port will be open to permit some amount of fluid flow therethrough.

The system further includes a port opening delay mechanism 20 configured to act after actuation of the sliding sleeve 16. After the sliding sleeve 16 is in the active position, port opening delay mechanism 20 acts to slow movement of the port-closure such that it only reaches the port-open position after a selected time has lapsed, that selected time being longer than the time it would take the closure to move from the port-closed to the port-open position if the delay mechanism was not in place.

Tubular housing 10 can be formed as a sub, such as one to be installed in a wellbore tubing string. Such a sub may include ends (not shown) formed for connection to adjacent tubulars in the string. Suitable forming may include, for example, threading, tapering, etc. Generally, tubular housing 10 will be cylindrical but other forms may be employed.

Port 14 extends through the wall of the tubular housing, providing fluid access through the wall. The fluid access may flow inwardly or outwardly through the port between inner bore 12 and the housing's outer surface 10*a* (as shown) or between the inner bore and a tubing supported tool, such as a packer setting mechanism, etc. The port may be open or have a fluid controller therein, such as for example, a choke, a nozzle, a screen, etc. Ports 14, as shown, are threaded and therefore capable of having limited entry chokes installed therein, such that they can have selectable fluid flow properties.

Sliding sleeve 16 moves axially through the tubular housing when moving from the port-closed to the port open position. This movement could be along the outer surface alternately. In this embodiment, sleeve 16 moves towards surface, arrows B, when moving to the port-open position, but this could be reversed with a few modifications.

Figure 1D:
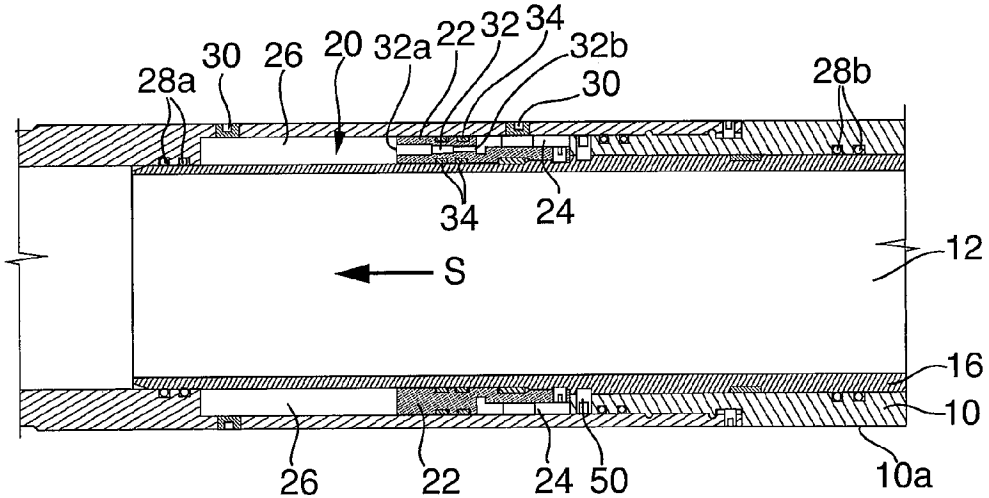
FIGS. 1D and 1E are enlarged views of the sleeve valve of FIG. 1A.
Figure 1E:
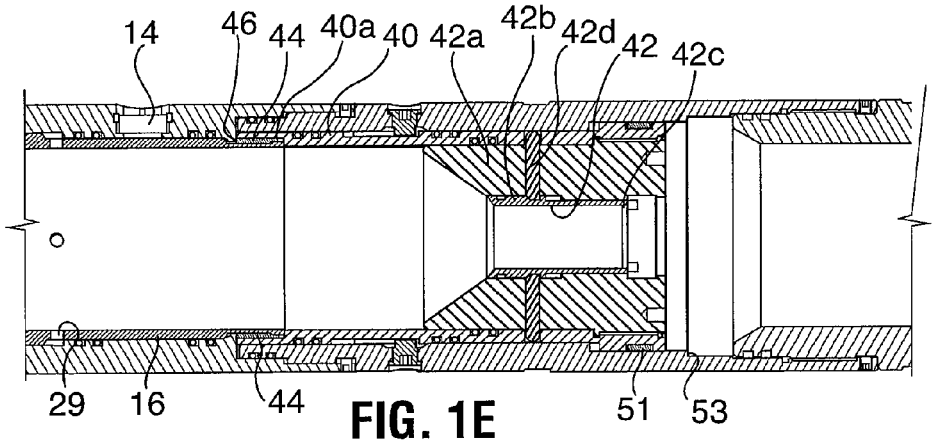

Port opening delay mechanism 20 acts to slow movement of the port-closure such that it only reaches the port-open position after a selected, time has lapsed, that selected time being longer than the time it would take the closure to move from the port-closed to the port-open position if the delay mechanism was not in place. The port opening delay mechanism is configured to act after actuation of sleeve 16 to resist, and therefore delay, opening of the port to fluid flow therethrough until after the selected time has lapsed. In this embodiment, the delay mechanism includes a hydraulic chamber between housing 10 and sleeve 16 that has metered movement of hydraulic fluid therein to slow any movement between the parts. In particular, in the embodiment of FIG. 1, as best seen in FIG. 1D, the delay mechanism 20 includes hydraulic chamber with a metering valve 22 moveable therein, which separates the chamber into a first hydraulic chamber 24 and a second hydraulic chamber 26. The metering valve is driven by relative movement between housing 10 and sleeve 16 to move through the chamber, reducing the size of one chamber, while at the same time increasing the size of the other chamber such that fluid must move through a restriction in metering valve 22 from one chamber to the other. Thus, while the sleeve, after being actuated, can move toward its port-open position, it is slowed in that movement by the resistance exerted by metering valve in the hydraulic chamber.

The chamber is, in this embodiment an annular space between housing 10 and the sleeve. Seals 28*a* and 28*b*, such as o-rings in glands, are positioned between sleeve 16 and the inner wall of the tubular housing at either end of the chamber to pressure isolate the chamber from inner diameter 12 and from fluid pressures about outer surface 10*a*. As such any fluid in the chamber, which may be introduced through ports 30, is trapped in the chamber. In the illustrated embodiment, chamber 24 is filled with air and chamber 26 is filled with a hydraulic fluid, such as oil, both at atmospheric pressure. While both chambers could be filed with any fluid, a hydraulic fluid offers predictable viscosity and cannot immediately flow through valve 22 such that the flow, while capable of occurring through valve, occurs at a slow rate. While both chambers could be filled with the same fluid, having a compressible fluid in the receiving chamber allows for pressure relief should the hydraulic-fluid filled chamber undergo pressure fluctuations while handling, such as when being moved from surface into borehole conditions.

Metering valve 22, in this embodiment, is secured to the outer surface of sleeve 16. The metering valve therefore moves with the sleeve. Metering valve 22 includes an annular ring that separates the annular chamber into the two chambers 24, 26. The movement of sleeve 16 to achieve port-opening, forces metering valve 22 to move through the chamber to increase the volume of first chamber 24 while reducing the volume of second chamber 26. In response to this relative volume change between the two chambers, one's volume increasing and the other's volume decreasing, hydraulic fluid in the chamber of decreasing volume must pass the restriction presented by metering valve to permit the sleeve movement. In the illustrated embodiment, the restriction includes an orifice 32 providing limited fluid movement between the two chambers 24, 26 through openings 32*a*, 32*b*. Seals 34 prevent fluid from bypassing around the piston. While sleeve could otherwise move readily within the housing, the movement is resisted by the restriction of metering valve 22 moving through the hydraulic-fluid-filled chamber. Thus, the valve 22 slows movement of the sleeve, corresponding to the rate at which the hydraulic fluid in the chamber may pass through the valve's fluid orifice 32.

It will be appreciated that various modifications can be made to the delay mechanism. For example, the piston could be carried on the housing. In one embodiment, the delay mechanism is adjustable to control the degree of resistance imparted thereby. For example in an embodiment employing a hydraulic chamber, the viscosity of the hydraulic fluid and/or the size of the valve orifice can be selected, to control the metering effect and therefore the delay imparted by the mechanism.

The port closure, in this embodiment, sleeve 16 may be actuated to begin the port opening process by a pressure driven mechanism. The pressure driven mechanism actuates the closure to an active position (FIG. 1B) where the closure can move from the port-closed position to the port-open position. The pressure driven mechanism may vary depending on the sleeve. In one embodiment, for example, the pressure driven mechanism is incorporated in the closure mechanism such as, for example, in a fluid pressure responsive valve as described in the above-noted application WO 2009/132462. As described therein, the fluid pressure responsive valve is actuated in response to pressure differentials across the valve to begin opening. The actuation is a release of the sleeve such that it becomes free to move to the port-open position.

In FIG. 1, the pressure driven mechanism involves the use of a pressure driven tool. FIGS. 1A to 1E show one embodiment of a tool and FIGS. 1F and 1G show another embodiment. In FIGS. 1A to 1E: FIG. 1E shows the assembly pre-actuation (in a run-in condition); FIG. 1A shows the assembly mid-actuation; FIG. 1B shows the assembly after actuation, when sleeve 16 is activated and ready to move; and FIG. 1C shows the assembly after sleeve 16 has moved. In FIGS. 1F and 1G: FIG. 1F shows the assembly mid-actuation and FIG. 1G shows the assembly after actuation, when sleeve 16 has moved.

In these embodiments, sleeve 16 is actuated to begin the port opening process by a pressure driven tool that acts by direct contact or proximity to actuate the closure to begin moving to the port-open position. The pressure driven tool is drivable through the tubular housing by fluid pressure. The pressure driven tool may take various forms, for example, it may be single or multipart. In one embodiment, for example, the pressure driven tool includes a conveyed part, such as a plug 36, for example a ball (as shown) or dart, etc. that lands against a release mechanism, such as a sleeve with a seat, a latch, etc. that is substantially not pressure drivable until the conveyed part is landed thereagainst. In the illustrated embodiment, for example, the assembly includes an activation sleeve 40 with a seat 42 formed thereon sized to act with plug 36. Plug 36 and seat 42 are correspondingly sized such that when plug 36 is pressure driven through the tubular housing 10, the plug cannot pass through the seat. Plug 36 therefore lands on the activation sleeve's seat 42 and, the sleeve with the plugging device landed therein, occludes inner bore 12 of the tubular housing to create a pressure differential across the activation sleeve. Sleeve 40, therefore, can be driven along by the pressure differential toward the low pressure side, arrow A, and this movement can actuate, and in particular release, sleeve 16 to begin to move, arrow B, to the port-open position (FIG. 1C).

The pressure driven tool can serve further purposes in the wellbore. For example, in one embodiment as shown, plug 36, once having actuated the sleeve, may pass through seat 42 and may continue on and land on a seat (not shown) below. The seat may serve various purposes, after it has plug 36 landed therein. For example, it may act to divert fluid to ports 14, once they are opened. As such, seat 42, while formed to initially retain plug 36, may also be formed to be overcomeable, such as by deformation, so, that plug 36 can pass through the seat and proceed downhole.

The actuation assembly as illustrated, includes activation sleeve 40 with seat 42 and plug 36 sized to be retained in seat 42 long enough to cause actuation of the system. Seat 42 is deformable and includes a main body 42*a* installed in sleeve 40 and a subsleeve 42*b* slidably installed in a bore through main body 42*a*. The subsleeve 42*b* defines the bore through which plug 36 passes and is retained. In particular, annular ledge 42*c* creates a stop against which the plug is caught when passing through the bore of the subsleeve 42*b*. The subsleeve is locked in a first position by keys 42*d*, FIG. 1A, 1E. In the first position, subsleeve 42*b* is captured radially in the bore of main body 42*a* such that the subsleeve's walls about ledge 42*c* cannot radially expand. However, if keys 42*d* are retracted, the subsleeve is freed to move to a second position, FIG. 1B. In the second position, the subsleeve's walls about ledge 42*c* extend into an enlarged diameter area in the bore of main body 42*a*, such that the walls can be expanded radially to enlarge the diameter across ledge 42*c*. Keys 42*d* can retract when main activation sleeve 40 moves down into a releasing position (FIG. 1B, 1F), where the keys 42*d* are positioned in a space where they have room to retract. Plug 36 is retained in subsleeve 42*b* when it is in the first position and plug 36 can pass through subsleeve 42*b* when it is in the second position, which is the position achieved after plug 36 has driven activation sleeve 40 to actuate sleeve 16.

While activation sleeve 40 could operate in numerous ways to actuate sleeve 16, to free it for movement, it is noted that sleeve 40 is initially secured to sleeve 16 by a C-ring lock 44 wedged between the sleeves. C-ring lock 44 is positioned in an annular gland 46 in an end extension of sleeve 16 and is supported at its back side by an annular extension 40*a* of sleeve 40. When sleeve 40 is pulled out from behind C-ring lock 44, it is free to expand out of gland 46 and sleeve 16 is freed by the actuation assembly to move.

The actuator may include a releasable lock that is released by the pressure driven mechanism. For example, shear pins may be employed to ensure sleeve 40 is initially locked in position. Shear pins 50 may be used to ensure that sleeve 16 does not inadvertently move out of position. However, the shear pins are selected to have a holding force capable of being overcome by appropriate pressures.

Locks may also be employed to hold the parts in their final positions. For example, a C-ring lock 51 may be employed to ensure sleeve 40 remains in its position after activation of sleeve 16. C-ring lock 52 may be positioned to engage between sleeve 16 and housing 10 after sleeve 16 has moved to the port-open position, to ensure that sleeve 16 does not inadvertently move out of the port-open position.

Figure 1F:
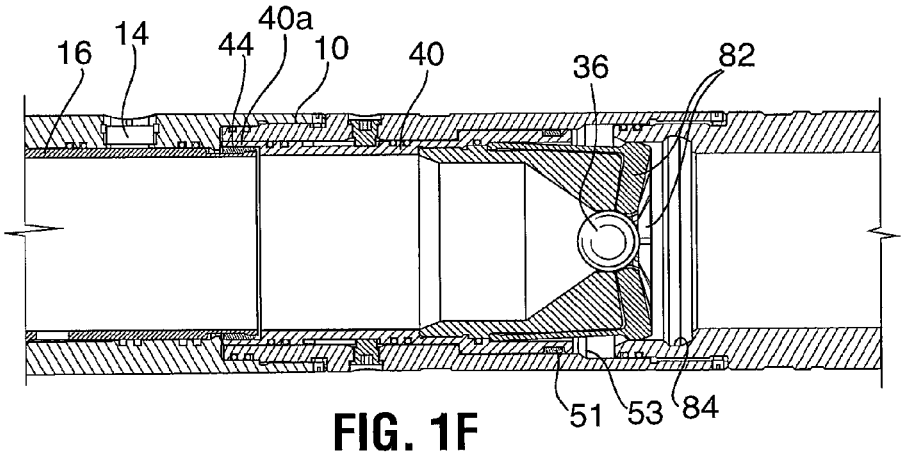
FIGS. 1F and 1G are enlarged views of another activation mechanism for a sleeve valve.
Figure 1G:
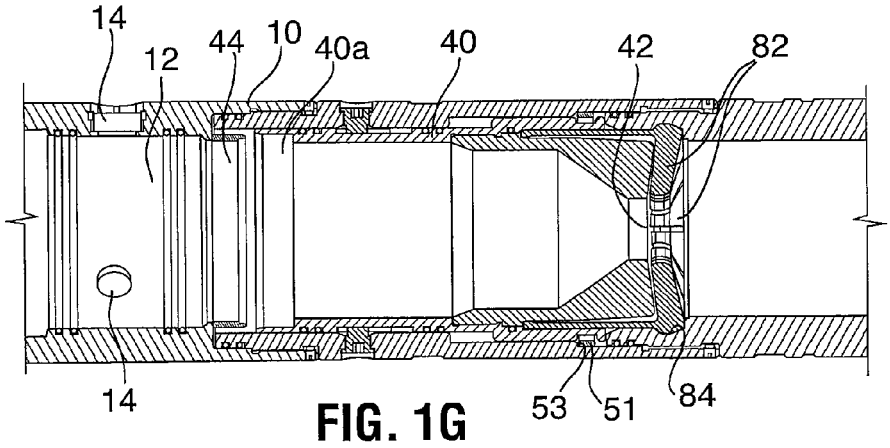

While a sleeve with deformable subsleeve has been disclosed as the activation mechanism for the system, the activation of sleeve 16 for movement may be accomplished in various ways. For example, FIG. 1F shows an alternative deformable seat. In this embodiment, seat 42 is formed by a plurality of collet fingers 82 that are compressed together during run in to form the ball-catching seat, but are pushed into a recess 84 that allows fingers to expand, when the activation sleeve 84 is driven by the plug and fluid pressure.

The above-noted pressure driven plugging device and sleeve actuates the closure by direct manipulation. In another embodiment, the pressure driven tool may operate by proximity such as by emitting a signal that is detected by the closure. In such an embodiment, for example, the pressure driven tool is conveyable, such as including a non-plugging dart, a plug (such as a ball or dart), etc. that emits a signal and the closure's actuator includes a receiver that receives the signal. The pressure driven tool signals the actuator to begin the opening process, when the pressure driven tool passes in signaling proximity thereto. In one of these embodiments, for example, the conveyed tool and actuator may employ RF technology for emitters and receivers. Such technology is disclosed, for example, in US Patent Document 2007/0272411. As such, it is to be understood that there are various ways to actuate the closure to assume its port-open condition.

From the foregoing, it will be appreciated that the pressure driven tool may actuate the closure to begin opening, but in this embodiment does not actually drive the closure open. For example, in one embodiment, a conveyed tool may land against a tubing ID restriction and may apply a force as it passes the restriction, which force actuates the closure to begin the opening process. However, the conveyed tool may initiate but not actually drive the closure to open. In such an embodiment, a driver may be required, as discussed below, to impart a drive force to the closure. Thus, the port closure system may further include a driver that provides the energy to move the closure to the open position, after it is actuated. The driver may include one or more of a motor, a biasing member such as a spring or a pressure charge (i.e. a nitrogen chamber charge or an atmospheric pressure chamber), a piston configuration to respond to differential well/tubing pressures, etc. While the driver may be capable of applying a force to rapidly move the closure from the port-closed to the port-open position, the port opening delay mechanism resists and therefore slows such movement. A driver may permit a closure to be moved without maintaining the original pressure drive that initiated the movement. For example, if the actuation is by pressuring up the tubing string, the pressure may be dissipated but the driver continues to apply a driving force to the sleeve. In one embodiment, the driver may be selected to operate apart from the actuation of the closure. For example, the driver may be a biasing member that generates or stores energy that can only be dissipated after the sleeve is actuated to begin opening. In the illustrated embodiment, the driver includes opposing piston faces across which a pressure differential is established to drive the sleeve toward the lower pressure side. For example, seals 28*a* create one piston face and seals 28*b* create a second piston face. The larger diameter of seals 28*b* over seals 28*a* provides a greater surface area of seal 28*b* vs. seal 28*a*. The greater surface area of seals 28*b* compared to seals 28*a* creates a pressure differential across atmospheric chambers 24, 26 that drives the sleeve toward seals 28*a*. Fluid can be communicated to seals 28*b* through fluid ports 29.

Once the port is open, it can remain open, for example as assisted by C-ring lock 52, or a plug could be deployed after the fact to selectively close/open the port, after it is opened.

The delay mechanism allows pressurized operations to be conducted after actuation of a port to open, but that the port remains closed to fluid flow therethrough until after a selected time. For example, with reference to FIG. 1, the delay mechanism is in place to ensure that the activation device, plug 36, has time to travel and pre-activate the sliding sleeve and further tools below or above, before communication is established with the wellbore.

In operation, the wellbore tubular port closure system may be installed in a string and run into a wellbore. Plug 36 is released uphole of tubular 10 and is conveyed by gravity and fluid pressure to activation sleeve 40. When plug 36 reaches sleeve 40, it lands in seat 42. Pressure is increased from surface to break shear pins (not shown) and the sleeve 40 moves down (arrow A). This allows the release of C-ring lock 44. Lock ring 51 locks sleeve 40 in the shifted position when the ring expands behind a shoulder 53 in housing 10. After the sleeve shifts, the plug 36 continues to create a seal in the seat. Increased pressure yields the seat and allows the plug 36 to continue down the string. In particular, seat 42 yields when subsleeve 42*b* shifts and ledge 42*c* expands to release the plug.

With the release of C-ring lock 44, sleeve 16 is considered actuated, being free to move. Any pressure in the string then can act on the differential areas of seals 28*a*, 28*b* against the fluid filled chambers 24, 26. This causes sleeve 16 to begin shifting and overcomes any holding force exerted by shear pins 50. In this embodiment, the movement of sleeve 16 is uphole. Any movement of the sleeve is resisted and therefore slowed by the changing volume of chambers 24, 26, metering valve 22 between the chambers and the viscosity of the hydraulic fluid in chamber 26, which together act as a delay mechanism. In particular, the differential forces between seals 28*a* and 28*b* acting against the atmospheric conditions of the fluid in chambers, causes sleeve 16 to move toward seals 28*a* and this movement causes metering valve 22 to move with the sleeve through the annular chamber such that fluid is forced from chamber 26 to chamber 24 through orifice 32 of metering valve 22. In this embodiment, a driving force is applied to the sleeve after actuation thereof by ensuring that the seals 28*a*, 28*b* have a differential area and by selecting the pressure in the chambers to be less than the downhole pressures, considering the downhole temperature and pressure conditions. The delay mechanism acts against the force applied by the driver and slows the movement of the sleeve.

The driving force causes sleeve to continue to move until it is stopped for example when C-ring lock 52 expands into a gland in chamber 24 or become butted against a stop wall. In so doing sleeve 16 is withdrawn from its position covering port 14 such that port is opened. The driver, which is the effect of the differential areas of seals 28*a*, 28*b* acting against the atmospheric chambers 24, 26, continues to apply a driving force on the sleeve even after the port opens.

Once port 16 is opened, the wellbore processes intended to be effected through the port can proceed. For example, in one embodiment wellbore treatment fluids are injected out though the port, such as to effect a fracing operation.

While the above-noted sleeve is driven by pressure differentials between seals 28*a*, 28*b* acting against the atmospheric chambers 24, 26, it is to be understood that the driver that applies a driving force against the resistance of the delay mechanism, chambers 24, 26, could take other forms. For example, in one embodiment, the driver may be a pressure charged chamber, such as one containing nitrogen. In another embodiment, a spring may be used as the driver. In these embodiments, the pressure charge and the spring act to apply the driving force to urge the sleeve open, against the resistance of the delay mechanism.

While the above-noted closure is actuated by a pressure driven tool, as noted above, a delay mechanism can alternately be employed in a closure having a pressure driven mechanism that is operated in response to pressure differentials without physical actuation thereof. For example, the delay mechanism can be employed in a fluid pressure responsive valve as described in the above-noted application WO 2009/132462. With reference to FIG. 2, for example, a wellbore tubular port closure system in the form of a hydraulically actuable sleeve valve 110 for a downhole tool is shown that is actuated to begin opening in response to fluid pressure differentials across the valve. Sleeve valve 110 may include a tubular segment 112, a sleeve 114 supported by the tubular segment and a driver, shown generally at reference number 116, to drive the sleeve to move.

Sleeve valve 110 may be intended for use in wellbore tool applications. For example, the sleeve valve may be employed in wellbore treatment applications. Tubular segment 112 may be a wellbore tubular such as of pipe, liner casing, etc. and may be a portion of a tubing string. Tubular segment 112 may include a bore 112*a* in communication with the inner bore of a tubing string such that pressures may be controlled therein and fluids may be communicated from surface therethrough, such as for wellbore treatment. Tubular segment 112 may be formed in various ways to be incorporated in a tubular string. For example, the tubular segment may be formed integral or connected by various means, such as threading, welding etc., with another portion of the tubular string. For example, ends 112*b*, 112*c* of the tubular segment, shown here as blanks, may be formed for engagement in sequence with adjacent tubulars in a string. For example, ends 112*b*, 112*c* may be formed as threaded pins or boxes to allow threaded engagement with adjacent tubulars.

Figure 2A:
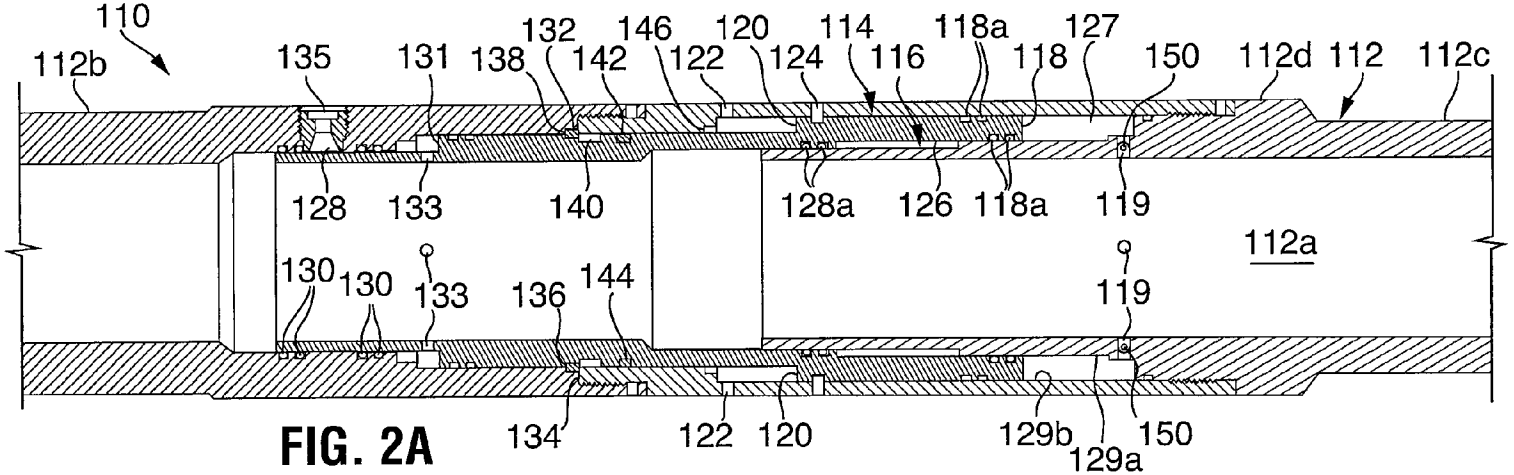
FIGS. 2A, 2B and 2C are a series of sectional views along another embodiment of a wellbore tubular port closure assembly in the form of a sleeve valve.
Figure 2B:
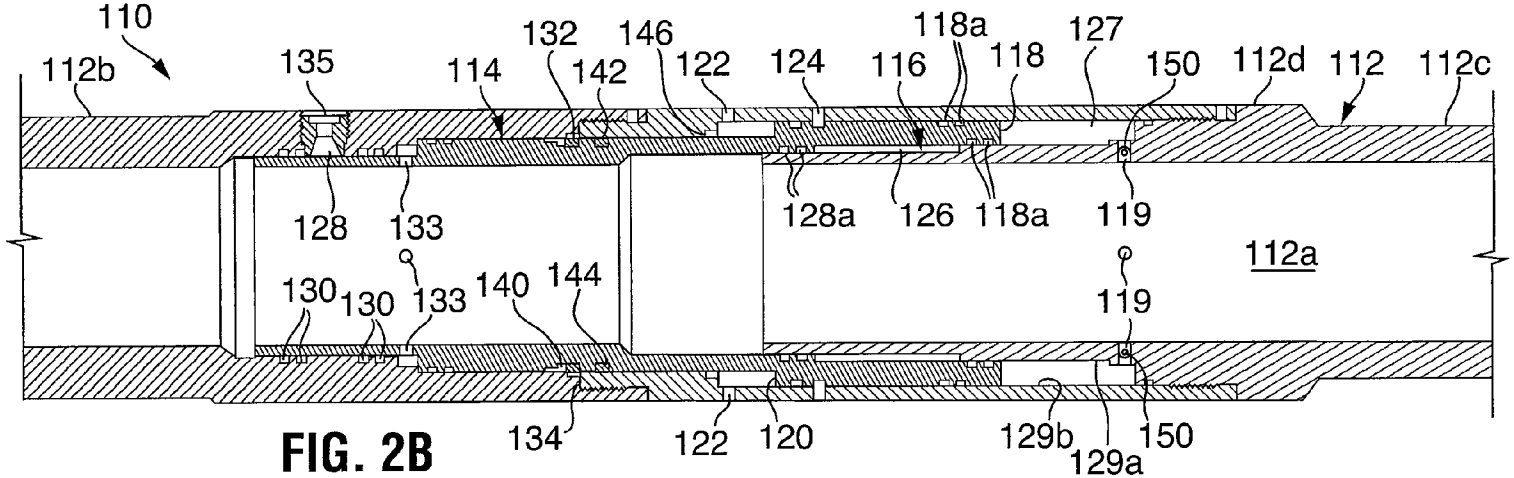
Figure 2C:
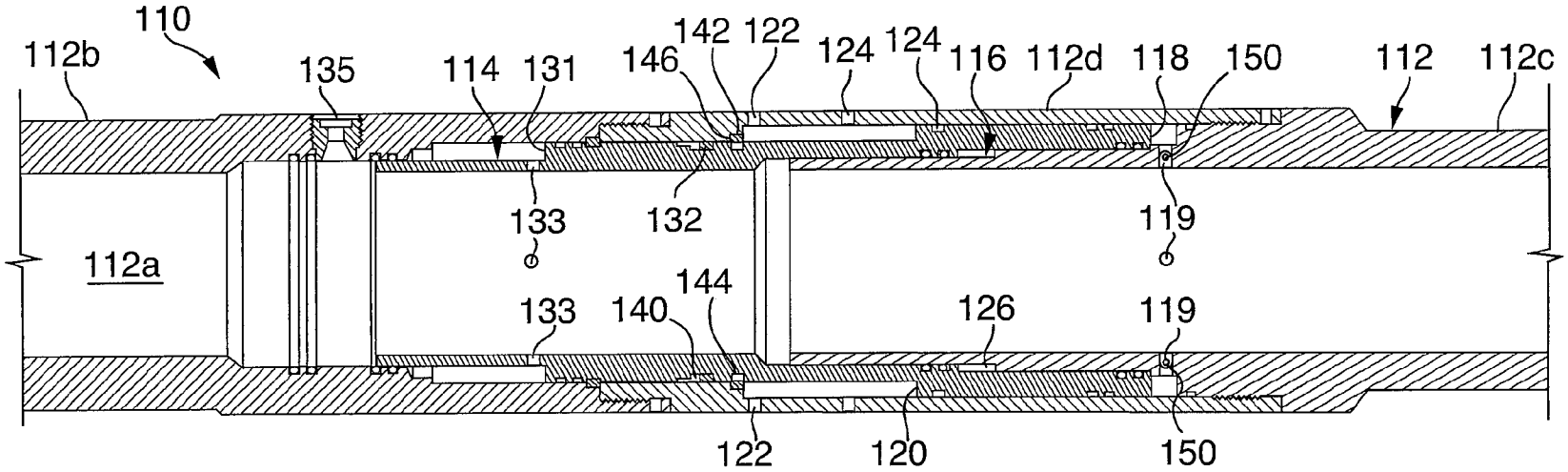

Sleeve 114 may be installed to act as a piston in the tubular segment, in other words to be axially moveable relative to the tubular segment at least some movement of which is driven by fluid pressure. Sleeve 114 may be axially moveable through a plurality of positions. For example, as presently illustrated, sleeve 114 may be moveable through a first position (FIG. 2A), a second position (FIG. 2B) and a final or third position (FIG. 2C). The installation site for the sleeve in the tubular segment is formed to allow for such movement.

Sleeve 114 may include a first piston face 118 in communication, for example through ports 119, with the inner bore 112*a* of the tubular segment such that first piston face 118 is open to tubing pressure. Sleeve 114 may further include a second piston face 120 in communication with the outer surface 112*d* of the tubular segment. For example, one or more ports 122 may be formed from outer surface 112*d* of the tubular segment such that second piston face 120 is open to annulus, hydrostatic pressure about the tubular segment. First piston face 118 and second piston face 120 are positioned to act oppositely on the sleeve. Since the first piston face is open to tubing pressure and the second piston face is open to annulus pressure, a pressure differential can be set up between the first piston face and the second piston face to move the sleeve by offsetting or adjusting one or the other of the tubing pressure or annulus pressure. In particular, although hydrostatic pressure may generally be equalized between the tubing inner bore and the annulus, by increasing tubing pressure, as by increasing pressure in bore 112*a* from surface, pressure acting against first piston face 118 may be greater than the pressure acting against second piston face 120, which may cause sleeve 114 to move toward the low pressure side, which is the side open to face 120, into a selected second position (FIG. 2B). Seals 118*a*, such as o-rings, may be provided to act against leakage of fluid from the bore to the annulus about the tubular segment such that fluid from inner bore 112*a* is communicated only to face 118 and not to face 120.

One or more releasable setting devices 124 may be provided to releasably hold the sleeve in the first position. Releasable setting devices 124, such as one or more of a shear pin (a plurality of shear pins are shown), a collet, a c-ring, etc. provide that the sleeve may be held in place against inadvertent movement out of any selected position, but may be released to move only when it is desirable to do so. In the illustrated embodiment, releasable setting devices 124 may be installed to maintain the sleeve in its first position but can be released, as shown sheared in FIGS. 2B and 2C, by differential pressure between faces 118 and 120 to allow movement of the sleeve. Selection of a releasable setting device, such as shear pins to be overcome by a pressure differential is well understood in the art. In the present embodiment, the differential pressure required to shear out the sleeve is affected by the hydrostatic pressure and the rating and number of shear pins.

Driver 116 may be provided to move the sleeve into the final position. The driver may be selected to be unable to move the sleeve until releasable setting device 124 is released. Since driver 116 is unable to overcome the holding power of releasable setting devices 124, the driver can only move the sleeve once the releasable setting devices are released. Since driver 116 cannot overcome the holding pressure of releasable setting devices 124 but the differential pressure can overcome the holding force of devices 124, it will be appreciated then that driver 116 may apply a driving force less than the force exerted by the differential pressure such that driver 116 may also be unable to overcome or act against a differential pressure sufficient to overcome devices 124. Driver 116 may take various forms. For example, in one embodiment, the driver may include a spring and/or a gas pressure chamber to apply a push or pull force to the sleeve or to simply allow the sleeve to move in response to an applied force such as an inherent or applied pressure differential or gravity. In the illustrated embodiment of FIG. 2, driver 116 employs hydrostatic pressure through piston face 120 that acts against trapped gas chamber 126 defined between tubular segment 112 and sleeve 114. Chamber 126 is sealed by seals 118*a*, 128*a*, such as o-rings, such that any gas therein is trapped. Chamber 126 includes gas trapped at atmospheric or some other low pressure. Generally, chamber 126 includes air at surface atmospheric pressure, as may be present simply by assembly of the parts at surface. In any event, generally the pressure in chamber 126 is somewhat less than the hydrostatic pressure downhole. As such, when sleeve 114 is free to move, a pressure imbalance occurs across the sleeve at piston face 120 causing the sleeve to move toward the low pressure side, as provided by chamber 126, if no greater forces are acting against such movement.

In the illustrated embodiment, sleeve 114 moves axially in a first direction when moving from the first position to the second position and reverses to move axially in a direction opposite to the first direction when it moves from the second position to the third position. In the illustrated embodiment, sleeve 114 passes through the first position on its way to the third position. The illustrated sleeve configuration and sequence of movement allows the sleeve to continue to hold pressure in the first position and the second position. When driven by tubing pressure to move from the first position into the second position, the sleeve moves from one overlapping, sealing position over port 128 into a further overlapping, port closed position and not towards opening of the port. As such, as long as tubing pressure is held or increased, the sleeve will remain in a port closed position and the tubing string in which the valve is positioned will be capable of holding pressure. The second position may be considered a closed but activated or passive position, wherein the sleeve has been acted upon, but the valve remains closed. In the presently illustrated embodiment, the pressure differential between faces 118 and 120 caused by pressuring up in bore 112*c* does not move the sleeve into or even toward a port open position. Pressuring up the tubing string only releases the sleeve for later opening. Only when tubing pressure is dissipated to reduce or remove the pressure differential, can sleeve 114 move into the third, port open position.

A delay mechanism may be installed in hydraulically actuable sleeve valve 110 to slow the final movement of sleeve 114 into the third, port open position. Various delay mechanisms may be provided. In the illustrated embodiment, ports 119 have installed therein with one-way check valves 150 that allow unrestricted flow of fluid into chamber 127, but allow only restricted evacuation of fluid from chamber 127 though ports 119. Valves 150 do not restrict movement of sleeve 114 from the first position into the second position, but resists movement of the sleeve from the second position into the third, port-open position. In particular, the valve restriction can be selected to allow some evacuation of fluid from chamber 127 but at a rate slower than what would be allowed if ports 119 were open. Any resistance created by valves 150 is selected to be less than the force of driver 116 such that the sleeve can move to the port-open position, but simply at a slower rate.

While the above-described sleeve movement may provide certain benefits, of course other directions, traveling distances and sequences of movement may be employed depending on the configuration of the sleeve, piston chambers, releasable setting devices, driver, etc. In the illustrated embodiment, the first direction, when moving from the first position to the second position, may be towards surface and the reverse direction may be downhole.

Sleeve 114 may be installed in various ways on or in the tubular segment and may take various forms, while being axially moveable along a length of the tubular segment. For example, as illustrated, sleeve 114 may be installed in an annular opening 127 defined between an inner wall 129*a* and an outer wall 129*b* of the tubular segment. In the illustrated embodiment, piston face 118 is positioned at an end of the sleeve in annular opening 127, with pressure communication through ports 119 passing through inner wall 129*a*. Also in this illustrated embodiment, chamber 126 is defined between sleeve 114 and inner wall 129*a*. Also shown in this embodiment but again variable as desired, an opposite end of sleeve 114 extends out from annular opening 127 to have a surface in direct communication with inner bore 112*a*. Sleeve 114 may include one or more stepped portions 131 to adjust its inner diameter and thickness. Stepped portions 131, if desired, may alternately be selected to provide for piston face sizing and force selection. In the illustrated embodiment, for example, stepped portion 131 provides another piston face on the sleeve in communication with inner bore 112*a*, and therefore tubing pressure, through ports 133. The piston face of portion 131 acts with face 120 to counteract forces generated at piston face 118. In the illustrated embodiment, ports 133 also act to avoid a pressure lock condition at stepped portion 131. The face area provided by stepped portion 131 may be considered when calculating the total piston face area of the sleeve and the overall pressure effect thereon. For example, faces 118, 120 and 131 must all be considered with respect to pressure differentials acting across the sleeve and the effect of applied or inherent pressure conditions, such as applied tubing pressure, hydrostatic pressure acting as driver 116. Faces 118, 120 and 131 may all be considered to obtain a sleeve across which pressure differentials can be readily achieved.

In operation, sleeve 114 may be axially moved relative to tubular segment 112 between the three positions. For example, as shown in FIG. 2A, the sleeve valve may initially be in the first position with releasable setting devices 124 holding the sleeve in that position. To move the sleeve to the second position shown in FIG. 2B, pressure may be increased in bore 112*a*, which pressure is not communicated to the annulus, such that a pressure differential is created between face 118 and face 120 across the sleeve. This tends to force the sleeve toward the low pressure side, which is the side at face 120. Such force releases devices 124, for example shears the shear pins, such that sleeve 114 can move toward the end defining face 120 until it arrives at the second position (FIG. 2B). Thereafter, pressure in bore 112*a* can be allowed to relax such that the pressure differential is reduced or eliminated between faces 118 and 120. At this point, since the sleeve is free from the holding force of devices 124, once the pressure differential is sufficiently reduced, the force in driver 116 applies a force to urge the sleeve toward the third position (FIG. 2C). In the illustrated embodiment, for example, the hydrostatic pressure may act on face 120 and, relative to low pressure chamber 126, a pressure imbalance is established that may tend to drive sleeve 114 to the third, and in the illustrated embodiment of FIG. 2C, final position.

However, in the illustrated embodiment, the force of driver 116 is resisted by the delay effect caused by valves 150 to slow the movement of sleeve 114 toward the final position. While the force of driver 116 is sufficient to force fluid from chambers 127, the movement of sleeve 114 by driver 116 is slowed by the resistance of fluid passing through the valves.

In summary, a pressure increase within the tubular segment causes a pressure differential that releases the sleeve and renders the sleeve into a condition such that it can be acted upon by a driving force to slowly move the sleeve, as permitted by the delay mechanism, to a further position. Pressuring up is only required to release the sleeve and not to move the sleeve into a port open position. In fact, since any pressure differential where the tubing pressure is greater than the annular pressure holds the sleeve in a port-closed, pressure holding position, the sleeve can only be acted upon by the driving force once the tubing pressure generated differential is dissipated. The sleeve may, therefore, be actuated by pressure cycling wherein a pressure increase within the tubular segment causes a pressure differential that releases the sleeve and renders the sleeve in a condition such that it can be acted upon by a driver, such as existing hydrostatic pressure, to move the sleeve to a further position.

The sleeve valve of the present invention may be useful in various applications where it is desired to move a sleeve through a plurality of positions, where it is desired to actuate a sleeve to open after increasing tubing pressure, where it is desired to open a port in a tubing string hydraulically but where the fluid pressure must be held in the tubing string for other purposes prior to opening the ports to equalize pressure and/or where it is desired to open a plurality of sleeve valves in the tubing string hydraulically at substantially the same time without a risk of certain of the valves failing to open due to pressure equalization through certain others of the valves that opened first. In the illustrated embodiment, for example, sleeve 114 in both the first and second positions is positioned to cover port 128 and seal it against fluid flow therethrough. However, in the third position, sleeve 114 has moved away from port and leaves it open, at least to some degree, for fluid flow therethrough. Although a tubing pressure increase releases the sleeve to move into the second position, the valve can still hold pressure in the second position and, in fact, tubing pressure creating a pressure differential across the sleeve actually holds the sleeve in a port closed position. Only when pressure is released after a pressure up condition, can the sleeve move to the port open position and, even then, such movement is slowed by the delay effect provided by valves 150. Seals 130 may be provided to assist with the sealing properties of sleeve 114 relative to port 128. Such port 128 may open to an annular string component, such as a packer to be inflated, or may open bore 112*a* to the annular area about the tubular segment, such as may be required for wellbore treatment or production. In one embodiment, for example, the sleeve may be moved to open port 128 through the tubular segment such that fluids from the annulus, such as produced fluids can pass into bore 112*a*. Alternately, the port may be intended to allow fluids from bore 112*a* to pass into the annulus.

In the illustrated embodiment, for example, a plurality of ports 128 pass through the wall of tubular segment 112 for passage of fluids between bore 112*a* and outer surface 112*d* and, in particular, the annulus about the string. In the illustrated embodiment, ports 128 each include a nozzle insert 135 for jetting fluids radially outwardly therethrough. Nozzle insert 135 may include a convergent type orifice, having a fluid opening that narrows from a wide diameter to a smaller diameter in the direction of the flow, which is outwardly from bore 112*a* to outer surface 112*d*. As such, nozzle insert 135 may be useful to generate a fluid jet with a high exit velocity passing through the port in which the insert is positioned. Alternately or in addition, ports 128 may have installed therein a choking device for regulating the rate or volume of flow therethrough, such as may be useful in limited entry systems. Port configurations may be selected and employed, as desired. For example, the ports may operate with or include screening devices. In another embodiment, the ports may communicate with inflow control device (ICD) channels such as those acting to create a pressure drop for incoming production fluids.

As illustrated, valve 110 may include one or more locks, as desired. For example, a lock may be provided to resist sleeve 114 of the valve from moving from the first position directly to the third position and/or a lock may be provided to resist the sleeve from moving from the third position back to the second position. In the illustrated embodiment, for example, an inwardly biased c-ring 132 is installed to act between a shoulder 134 on tubular member 112 and a shoulder 136 on sleeve 114. By acting between the shoulders, they cannot approach each other and, therefore, sleeve 114 cannot move from the first position directly toward the third position, even when shear pins 124 are no longer holding the sleeve. C-ring 132 does not resist movement of the sleeve from the first position to the second position. However, the c-ring may be held by another shoulder 138 on tubular member 112 against movement with the sleeve, such that when sleeve 114 moves from the first position to the second position the sleeve moves past the c-ring. Sleeve 114 includes a gland 140 that is positioned to pass under the c-ring as the sleeve moves and, when this occurs, c-ring 132, being biased inwardly, can drop into the gland. Gland 140 may be sized to accommodate the c-ring no more than flush with the outer diameter of the sleeve such that after dropping into gland 140, c-ring 132 may be carried with the sleeve without catching again on parts beyond the gland. As such, after c-ring 132 drops into the gland, it does not inhibit further movement of the sleeve.

Another lock may be provided, for example, in the illustrated embodiment to resist movement of the sleeve from the third position back to the second position. The lock may also employ a device such as a c-ring 142 with a biasing force to expand from a gland 144 in sleeve 114 to land against a shoulder 146 on tubular member 112, when the sleeve carries the c-ring to a position where it can expand. The gland for c-ring 142 and the shoulder may be positioned such that they align when the sleeve moves substantially into the third position. When c-ring 142 expands, it acts between one side of gland 144 and shoulder 146 to prevent the sleeve from moving from the third position back toward the second position.

The tool may be formed in various ways. As will be appreciated, it is common to form wellbore components in tubular, cylindrical form and oftentimes, of threadedly or weldedly connected subcomponents. For example, tubular segment in the illustrated embodiment is formed of a plurality of parts connected at threaded intervals. The threaded intervals may be selected to hold pressure, to form useful shoulders, etc., as desired.

A wellbore tubular port closure system with a delay mechanism can be employed in an apparatus for fluid treatment of a borehole. The port closure system allows for several ports to be opened in a single operation, without the concern of pressure losses due to some ports opening prematurely, for example, while pressurized operations are still being conducted.

In one embodiment, for example, the wellbore apparatus may incorporate therein a tubular port closure system as shown in FIG. 2. The apparatus may include a tubing string having a wall and defining a long axis and an inner bore with a tubular segment 112 of a tubular port closure system incorporated therein such that bore 112*a* is in communication with the inner bore of the tubing string. The system's port 128 may be positioned extending through the wall of the tubing string with sleeve 114 mounted over the port initially, during run in, in a port-closed position. As noted, the sleeve is moveable relative to the port from the port-closed position (FIG. 2A) through a closed, but activated position (FIG. 2B) and finally into a port-open position (FIG. 2C), permitting fluid flow through port 128 from the bore 112*a*. The tubular port closure system's releasable lock 124 holds sleeve 114 in the port-closed position and is actuable to release the sleeve for movement. The system's driver 116 is operable to apply a force to sleeve 114 to drive the first sleeve valve from the port-closed position to the port-open position, the force being resisted but not eliminated by a sleeve valve movement delay mechanism 150 configured to act, after actuation of the releasable lock, to slow movement of sleeve 114 into the port-open position until after a selected time has lapsed.

The apparatus also include a second tubular port closure system offset axially along the tubing string uphole or downhole from tubular segment 112. The second tubular port closure system is similar to the first and includes a second port extending through the wall of the tubing string; a second sleeve valve mounted over the second port in a port-closed position, the second sleeve valve being likewise moveable relative to the second port between the port-closed position and a port-open position permitting fluid flow through the second port from the tubing string inner bore. The second system may further include its own releasable lock, holding the second sleeve valve in the port-closed position and actuable to release the second sleeve valve for movement; a driver for applying a force to the second sleeve valve to drive the second sleeve valve from the port-closed position to the port-open position; and a sleeve valve movement delay mechanism for the second sleeve configured after actuation of the releasable lock to slow movement of the second sleeve valve into the port-open position until after a time has lapsed, that time being no faster than the selected time of the first tubular port closure system and in one embodiment, substantially similar to the selected time of the first tubular port closure system so that the two systems allow opening of their ports at approximately the same time.

There can be further port closure systems along the string, as desired.

Thus, the sleeve valve movement delay mechanisms in such a string are useful to ensure that pressure is held long enough in the string to ensure that all pressure driven operations, including the activation of sleeve 114 and the corresponding sleeve of the second system are completed before any of the ports open, at which time the pressure condition in the tubing string is lost.

Another wellbore fluid treatment apparatus is shown in FIG. 3, which can be used to effect fluid treatment of a formation 210 through a wellbore 212 and via one or more packer-isolated wellbore segments at a time. For example, the apparatus can be selected such that a plurality of ports along one or more packer-isolated intervals can be opened together to permit fluid treatment through the plurality of ports simultaneously. This approach may increase the speed at which a wellbore can be treated, while still permitting focused and selected treatment of the wellbore along considerable lengths thereof.

Figure 3A:
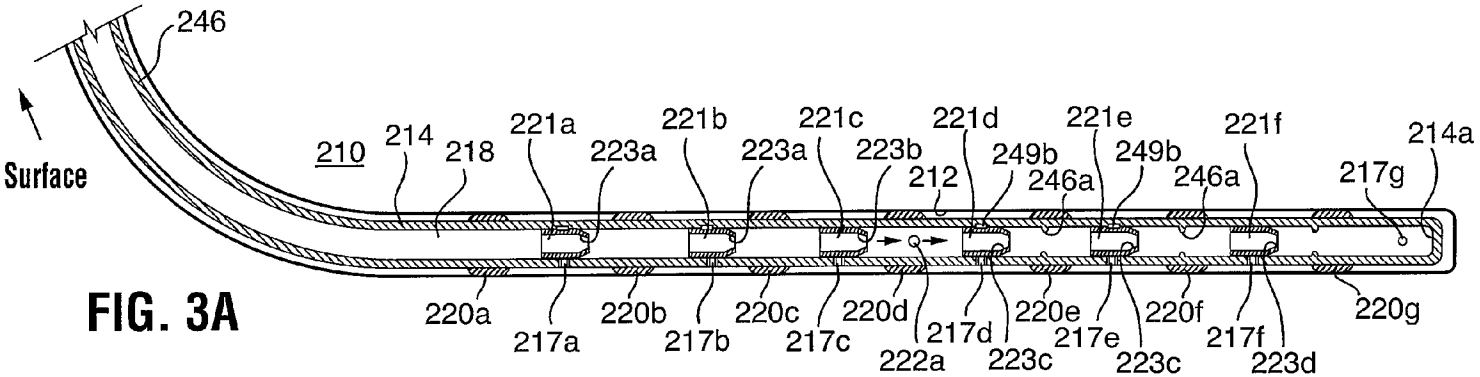
FIGS. 3A, 3B and 3C are a series of schematic illustrations of a wellbore treatment apparatus.

The wellbore assembly of FIG. 3A includes a tubing string 214 having a lower end 214*a*, an upper end 214*b* extending to surface (not shown) and an inner bore 218. Tubing string 214 includes a plurality of spaced apart ported intervals each including at least one port 217*a* to 217*g* opened through the tubing string wall to permit access between the tubing string inner bore 218 and the wellbore.

Packers 220*a* to 220*g* are mounted about the tubing string and can be set to seal the annular area between the tubing string and the wellbore wall, forming along the wellbore a plurality of packer-isolated wellbore segments between each adjacent set of packers. The ports 217*a* to 217*g* are positioned to each open into one wellbore segment. For example, packers 220*a* and 220*b* are mounted on opposite sides of the upper-most port 217*a* to form an annular isolated segment along the wellbore, which may be accessed through port 217*a*. The packers are disposed about the tubing string and selected to seal the annulus between the tubing string and the wellbore wall, when the assembly is disposed in the wellbore. The packers create annular seals along the tubing string outer diameter and when the string is installed in a wellbore and the packers set, they divide the wellbore into isolated segments through which fluid can be introduced to one segment of the well, but is prevented from passing through the annulus into adjacent segments. As will be appreciated, the packers can be spaced in any way relative to achieve a desired segment length or number of resulting segments per well or number of ports accessing each segment. The illustrated string is capable, as by setting the packers against the wellbore wall, of forming seven isolated segments along the wellbore, including the segment formed below the lowermost packer 220*g* in the toe of the wellbore. In some embodiments, the tubing string is capable of forming only a few isolated segments and in others, the tubing string has many packer separated ported intervals. For example, tubing strings having 3 to 24 packer isolated ports are possible and tubing string installations forming 40 to 20 packer-isolated wellbore segments are contemplated.

The packers may take various forms and may be selected depending on the application. For example, the illustrated packers are of the solid body-type with at least one extrudable packing element, for example, formed of rubber. Solid body packers including multiple, spaced apart packing elements on a single packer are particularly useful especially for example in open hole (unlined wellbore) operations. In another embodiment, a plurality of packers is positioned in side by side relation on the tubing string, rather than using one packer between each ported interval.

Closures 221*a* to 221*f* are positioned relative to each ported interval to control the flow through the ports of the interval. In this embodiment, closures close all the string's ports except the lower most port 217*g*. Port 217*g*, as illustrated, is part of a toe circulation sub, but can take other forms.

The closures of a first selected series of ports can be opened together by a closure actuator and the closures of a second selected series of ported intervals can be opened together by a closure actuator. While two series are illustrated, other numbers of series may be employed.

In this illustrated embodiment, the closures are each sleeve valves with seats 223*a*, 223*b*, 223*c*, and 223*d* and the closure actuators are pressure conveyed plugs, formed as balls 222*a*, 222*b* moveable through the tubing string inner diameter. Each ball is sized to at least temporarily seat in any of the seats that are appropriately sized for that ball and in so doing move the sleeve valves away from their ports. The balls 222*a* and 222*b* and seats 223*a* to 223*d* can be formed in various ways to work together to move the closures and open the ports as the balls pass through the tubing string.

Figure 3B:
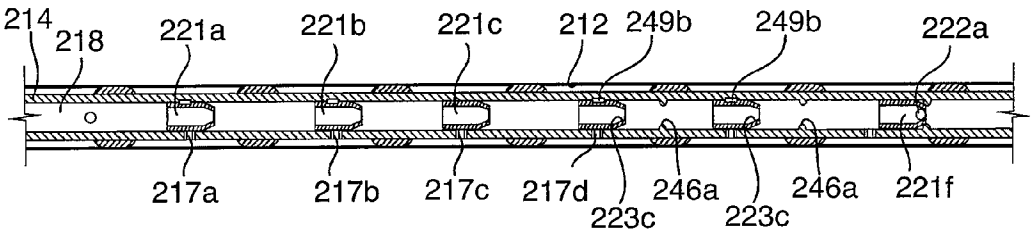
Figure 3C:
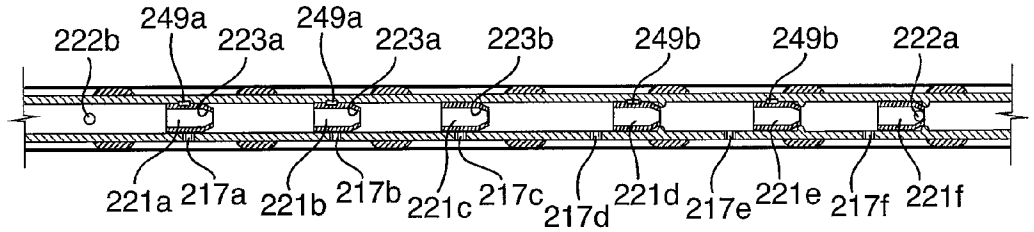

The position of the closures 221*d*, 221*e* and 221*f* in their closed positions is shown in FIG. 3A. FIG. 3B shows the closures 221*d*, 221*e* and 221*f* after they have been acted upon by their actuation ball 222*a*, with closures 221*d* and 221*e* activated but still closed and closure 221*f* opened with ball 222*a* retained in its seat 223*d*. FIG. 3C shows closures 221*d*, 221*e* and 221*f* after the selected time delay, with all ports 317*d* to 217*f* open.

The ports 217*d*, 217*e* and 217*f* are closed during run in by closures 221*d*, 221*e* and 221*f*, which, as noted, are formed as sleeve valves, and are held in place during run in by retainers such as shear pins. Closures 221*d* and 221*e* each have a similar seat form and dimension, shown as seat 223*c*, and closure 221*e* has seat 223*d*. Seats 223*c*, 223*d* all correspond with ball 222*a* such that closures 221*d* to 221*f* can all be actuated to move by launching one ball 222*a* to land in the seats 223*c*, 223*d*. In particular, seats 223*c*, 223*d* are all correspondingly sized such that ball 222*a* is retained in and makes a seal with these seats as the ball moves though the string. While seats 223*c* and 223*d* are each sized to be plugged and seal against the same size ball 222*a*, seats 223*c* only temporarily retain the ball while seat 223*d* is formed to be plugged and retain the ball. As such, after landing on seat 223*c* in closure 221*d*, the pressure of fluid that builds up behind the ball will apply a force to the closure causing it to be activated, in this case released for movement, such as by the shearing of shear pins. Thereafter, the ball can move through closure 221*d* and proceed to land in and seal against the seat in closure 221*e* and activate that closure before the ball passes through that closure and lands in and seals against seat 223*d* of closure 221*f*. The closures can therefore each be released for movement away from their ports by having ball 222*a* land into their seats to create a pressure differential above and below the ball and the seat to overcome the retainer.

It will be appreciated that the ball 222*a* must continue past the seat of each closure it reaches in order to act on the next seat in the series. Because ball 222*a* at least in horizontal sections, as shown, is conveyed by pressure, the loss of pressure during movement of the ball can jeopardize port opening operations. Thus, closures 221*d* and 221*e* are provided with a sleeve movement delay mechanism 249*b*, such as for example one of those described above, that slows the movement of the sleeves to a port-open after actuation, such as release, thereof. While the closures 221*d*, 221*e* might otherwise move immediately to the port-open position, as by being moved by the force exerted by ball 222*a*, sleeve movement delay mechanisms 249*b*, slow the movement of sleeve to the port-open position such that sufficient time is provided for ball 222*a* to land in seat 223*d* before the ports 217*d*, 217*e* open. The time of the delay is selected based on the distance the ball must travel from the first closure activated to final action needed to be effected by the ball. For example, in this illustrated embodiment, the longest delay time should be selected to be at least sufficient to provide enough time for the ball to move from the first closure 221*d*, through the second closure 221*e* and to closure 221*f*. The delay mechanisms of the closures could be configured to have different selected delay times, since the first closure 221*d* requires a delay greater than the delay of the second closure 221*e*, but it may be easier to simply use a mechanism that is consistent for all closures such that they all are slowed to the same general degree. In some embodiments, the selected time may not need to be precisely set, but a more general selection of delay mechanism components may be sufficient. For example, it may not be problematic if one port opens before the others, depending on the operation of the driver. Also, it may not be entirely problematic if one port opens before the ball lands in its final position, although this is best avoided.

Yieldable seats or balls may be employed which allow a pressure differential to be generated to apply sufficient activating force to the closure through which it is passing, but when the sleeve is stopped against further movement, such as by stopping against shoulders 246*a*, the ball can pass through the seat to continue to move down the tubing string, in this case to land and seal in seat 223*d*. In this illustrated embodiment, seats 223*c* are yieldable, as by being formed of deformable materials, such as a collet, a c- or segmented ring, a ring of detents or elastically or plastically deformable materials. Of course, seat 223*d* could be yieldable as well, but as shown, seat 223*d* is formed to retain the ball and permits isolation of the string therebelow from that above the seat such that fluids pumped after landing the ball can be diverted out through the ports 217*d*-217*f*.

The ports 217*d*-217*f* in this series can be size restricted to create a selected pressure drop therethrough permitting distribution of fluid along the entire series of ports, once they are open. For example, the amount of stimulation fluid that can exit each of the ports, when they are open, may be controlled by selecting the sizing (flow rating) of the individual frac port nozzles. For example, the ports may be selected to provide limited entry to segments access through ports 217*d*-217*f*. Limited entry technology relies on selection of the number, size and placement of fluid ports along a selected length of a tubing string such that critical or choked flow occurs across the selected ports. Such technology ensures that fluid can be passed through the ports in a selected way along the selected intervals. For example, rather than having uneven or unrestricted flow through ports, after they are open, a limited entry approach may be used by selection of the rating of choking inserts in those ports to ensure that, under regular pump pressure conditions, an amount of fluid passes through each port at a substantially even and sufficient rate to ensure that a substantially uniform treatment occurs along the entirety of the wellbore. Even is pump pressure is increased, the choke only allows a limited amount of fluid to escape per time interval such that the supplied fluid can be adequately injected through a number of ports. Also, as noted above, if one port opens before the ball lands in its final position, a limited entry set up ensures that the port opened does not allow a full pressure escape, but that while the port is opened and fluid can flow through that port, sufficient tubing pressure is maintained to continue to move the ball along the string and to continue to have sufficient pressure to drive string operations as needed.

The ports 217*a* to 217*c* are closed during run in by closures 221*a*, 221*b* and 221*c*, in this embodiment formed as sleeve valves with ball seats 223*a*, 223*b* (FIG. 3A). During the process of opening ports 217*d* to 217*f* (FIGS. 3B, 3C), ports 217*a* to 217*c* are unaffected, as their seats 223*a*, 223*b* are sized to permit ball 222*a* to pass without any effect. Seats 223*a*, 223*b* are larger than seats 223*c*, 223*d* such that ball 222*a* can move through seats 223*a*, 223*b* without creating a seal thereagainst such that closures 217*a* to 217*c* are not moved by ball 222*a*. When it is desired to open the ports 217*a* to 217*c*, ball 222*b* is dropped (FIG. 3C), that ball being sized to act on the seats of the closures covering those ports. As noted above, seats 223*a* are yieldable such that ball 222*b* can temporarily land in the seats 223*a* to activate the closures 221*a* and 221*b*, but ball 222*b* moves through seats 223*a* to arrive at and land in seat 223*b*. Throughout the ball's progress, it acts in each seat 223*a* to activate closures 221*a*, 221*b* to begin opening. However, the opening of closures 221*a*, 221*b* is slowed by delay mechanisms 249*a*, such that the closures will not fully move to open their ports until ball 222*b* lands in seat 223*b*.

In operation, the tubing string apparatus of FIG. 3A is run into the well and packers 220*a* to 220*g* are set to create isolated annular segments along the wellbore. Thereafter, fluid may be injected through port 217*g* to treat the wellbore about the toe 214*a* of the string and in turn balls 222*a*, 222*b* can be launched and fluid injected to treat the wellbore segments accessed through ports 217*d* to 217*f* first and, thereafter, ports 217*a*-217*c*. The delay mechanisms of certain closures in each series permit the closures to be actuated to open by the pressure driven ball, but the closures don't immediately open such that pressure conditions are not jeopardized.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A sleeve valve assembly comprises: a tubular housing; a port through the wall of the tubular housing, a sleeve valve installed in the tubular housing and being moveable within the tubular housing from a port-closed position covering the port to a port-open position exposing the port to fluid flow therethrough; a releasable lock holding the sleeve valve in the port-closed position and actuable to release the sleeve valve for movement, the releasable lock including a lock ring engaged between the sleeve valve and an activation sleeve, the activation sleeve including a plug-catching seat sized to retain and create a seal with a pressure conveyed plug to release the activation sleeve and to release the lock ring from engagement with the sleeve valve; a driver for applying a force to the sleeve valve to drive the sleeve valve from the port-closed position to the port-open position; and a sleeve valve movement delay mechanism configured after actuation of the releasable lock to delay movement of the sleeve valve into the port-open position until after a selected time has lapsed, the sleeve valve movement delay mechanism including a first hydraulic chamber and a second hydraulic chamber separated by a metering valve, the metering valve being moveable to increase the volume of the first hydraulic chamber and decrease the volume of the second hydraulic chamber when the sleeve valve moves toward the port-open position.

2. The sleeve valve assembly of claim 1 wherein the releasable lock is releasable in response to a pressure differential.

3. The sleeve valve assembly of claim 1 wherein the plug-catching seat is deformable to permit the pressure conveyed plug to pass.

4. The sleeve valve assembly of claim 1 wherein the driver is selected from the group consisting of a spring, a piston across which a pressure differential is generated or a pressure charge.

5. A wellbore tubing string apparatus comprising: a tubing string having a wall and a distal end and defining a long axis and an inner bore; a first port extending through the wall of the tubing string; a first closure for the first port, the first closure maintaining the first port in a port-closed condition sealing against fluid flow through the first port and being actuable to an opened condition exposing the first port to fluid flow from the inner bore; a second port extending through the wall of the tubing string, the second port offset from the first port along the long axis of the tubing string; a second closure for the second port, the second closure maintaining the second port in a port-closed condition sealing against fluid flow through the second port and being actuable to an opened condition exposing the second port to fluid flow from the inner bore; a pressure driven tool moveable through the tubing string inner bore to actuate the first closure and the second closure to assume active positions where the first closure and the second closure can move from their port-closed positions to their port-open positions; a port opening delay mechanism configured to act after actuation by the pressure driven tool to resist movement of the first closure such that opening of the first port to fluid flow therethrough is delayed until after a selected time has lapsed; and a non-deformable seat between the second port and the distal end and the non-deformable seat configured to stop movement of the pressure driven tool through the tubing string after actuation of the first closure and the second closure.

6. The wellbore tubing string apparatus of claim 5 wherein the selected time is at least as long as a travel time for the pressure driven tool to move from the first closure to the second closure.

7. The wellbore tubing string apparatus of claim 5 wherein the second closure moves to the port-open position as soon as the pressure driven tool actuates the second closure.

8. The wellbore tubing string apparatus of claim 5 wherein the first closure includes a deformable seat formed to temporarily catch and seal with the pressure driven tool to generate a pressure driven force to actuate the first closure and the deformable seat thereafter yields to release the pressure driven tool.

9. The wellbore tubing string apparatus of claim 5 wherein the pressure driven tool is a plug.

10. The wellbore tubing string apparatus of claim 5 wherein the second closure includes the non-deformable seat formed to catch and seal with the pressure driven tool to generate a pressure driven force to actuate the second closure and drive it to the port-open position.

11. A method for opening fluid flow ports in a tubing string installed in a wellbore, the tubing string having a wall and defining a long axis and an inner bore; a first port extending through the wall of the tubing string; a first sleeve valve mounted over the first port in a port-closed position, the first sleeve valve being moveable relative to the first port between the port-closed position and a port-open position permitting fluid flow through the first port from the tubing string inner bore; a second port extending through the wall of the tubing string, the second port offset from the first port along the long axis of the tubing string; a second sleeve valve mounted over the second port in a port-closed position, the second sleeve valve being moveable relative to the second port between the port-closed position and a port-open position permitting fluid flow through the second port from the tubing string inner bore, the method comprising: introducing a tool to the tubing string; forcing the tool through the tubing string, past the first sleeve valve and to the second sleeve valve using fluid pressure, the tool actuating the first sleeve valve and the second sleeve valve to be released for movement from their port-closed positions to their port-open positions; providing resistance to movement of the first sleeve valve such that the first sleeve valve fails to reach the port-open position until after the tool reaches a ball stop position; retaining the tool in the ball stop position by fluid pressure to pressure isolate the inner bore below the tool from an upper portion of the inner bore above the tool; and diverting treatment fluid to the first port and the second port.

12. The method of claim 11 wherein the ball stop position is a seat of the second sleeve valve.

13. The method of claim 11 wherein providing resistance includes operating a sleeve valve movement delay mechanism to resist a driving force urging the first sleeve valve open.

14. The method of claim 11 wherein providing resistance includes metering evacuation of fluid from a chamber with a volume being reduced by movement of the first sleeve valve.

15. The method of claim 11 wherein actuating the first sleeve valve includes landing the tool in an activation sleeve to remove a releasable lock and expelling the tool from the activation sleeve to continue on to the ball stop position.

16. The method of claim 11 further comprising applying a driving force to the first sleeve valve.

17. A method for opening fluid flow ports in a tubing string, the tubing string having a wall, an end extending toward surface and a lower distal end; and defining a long axis and an inner bore; a first port extending through the wall of the tubing string; a first sleeve valve mounted over the first port in a port-closed position, the first sleeve valve being moveable relative to the first port between the port-closed position and a port-open position permitting fluid flow through the first port from the tubing string inner bore; a second port extending through the wall of the tubing string, the second port offset from the first port along the long axis of the tubing string; a second sleeve valve mounted over the second port in a port-closed position, the second sleeve valve being moveable relative to the second port between the port-closed position and a port-open position permitting fluid flow through the second port from the tubing string inner bore, the method comprising: actuating the first sleeve valve and the second sleeve valve to be released for movement from their port-closed positions to the port-open positions; and metering evacuation of fluid from a first chamber with a volume being reduced by movement of the first sleeve valve and receiving the fluid in a second chamber while the fluid remains isolated from fluid pressure in the inner bore, such that the first sleeve valve moves at a slowed rate toward the port-closed position.

18. The method of claim 17 wherein metering evacuation resists a driving force urging the first sleeve valve open.

19. The method of claim 17 wherein actuating the first sleeve valve includes landing a pressure conveyed tool in a seat of the first sleeve valve to apply pressure to the sleeve and release it for movement, and actuating the second sleeve valve includes landing the pressure conveyed tool in a seat of the second sleeve valve to apply pressure to the second sleeve valve sleeve and release the second sleeve valve for movement.

20. A sleeve valve assembly comprising: a tubular housing having an upper end and a lower end; a port through the wall of the tubular housing; a sleeve valve installed in the tubular housing and being moveable toward the upper end within the tubular housing from a port-closed position covering the port to a port-open position exposing the port to fluid flow therethrough; an activation sleeve installed in the tubular housing and being moveable toward the lower end to release the sleeve valve for movement to the port-open position; a driver for applying a force to the sleeve valve to drive the sleeve valve toward the upper end from the port-closed position to the port-open position; and a sleeve valve movement delay mechanism configured after actuation of the releasable lock to resist the force applied by the driver.

21. The sleeve valve assembly of claim 20 further comprising a plug-catching seat on the activation sleeve.

22. The sleeve valve assembly of claim 21 wherein the plug-catching seat is deformable.

23. The sleeve valve assembly of claim 20 further comprising a lock ring engaged between the sleeve valve and the activation sleeve and movement of the activation sleeve releases the lock ring from engagement with the sleeve valve.

24. A sleeve valve assembly comprising: a tubular housing; a port through the wall of the tubular housing, a sleeve valve installed in the tubular housing and being moveable within the tubular housing from a port-closed position covering the port to a port-open position exposing the port to fluid flow therethrough; a releasable lock holding the sleeve valve in the port-closed position and actuatable to release the sleeve valve for movement; a driver for applying a force to the sleeve valve to drive the sleeve valve from the port-closed position to the port-open position; a hydraulic chamber between the sleeve valve and the tubular housing, the hydraulic chamber including a first sub chamber; a second sub chamber; and a flow restrictor to limit flow of the fluid between the first sub chamber and the second sub chamber; and fluid sealed and flowable within the hydraulic chamber to resist movement of the sleeve valve from the port-closed position to the port-open position, wherein in the port-closed position, the fluid is contained in the first sub chamber and the second sub chamber contains a compressible gas.

25. The sleeve valve assembly of claim 24 wherein movement of the sleeve valve from the port-closed position to the port-open position decreases the volume of the first sub chamber and increases the volume of the second sub chamber.

* * * * *